US006593272B2

(12) United States Patent
Kakuda et al.

(10) Patent No.: US 6,593,272 B2
(45) Date of Patent: Jul. 15, 2003

(54) THERMOSENSITIVE RECORDING COMPOSITION AND THERMOSENSITIVE RECORDING MATERIAL USING THE SAME

(75) Inventors: Tomohisa Kakuda, Shizuoka (JP); Takeshi Kajikawa, Shizuoka (JP); Hiroshi Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/728,306

(22) Filed: Dec. 1, 2000

(65) Prior Publication Data

US 2001/0003729 A1 Jun. 14, 2001

(30) Foreign Application Priority Data

Dec. 9, 1999 (JP) ..... 11-350774

(51) Int. Cl.[7] ..... B41M 5/30

(52) U.S. Cl. ..... 503/209; 106/31.18; 503/207; 503/216; 503/221

(58) Field of Search ..... 503/208, 209, 503/216, 217, 221, 200, 226, 207; 106/31.18

(56) References Cited

U.S. PATENT DOCUMENTS 4,833,118 A * 5/1989 Kawakami et al. ..... 503/208
4,888,321 A * 12/1989 Kawakami et al. ..... 503/208
5,231,068 A * 7/1993 Miyamoto et al. ..... 503/207
5,484,758 A * 1/1996 Wald ..... 503/214

FOREIGN PATENT DOCUMENTS

EP 0618082 10/1994

OTHER PUBLICATIONS

Patent Abstracts of Japan, vol. 011, No. 094(M–574), Mar. 25, 1987, abstract of JP 61 246088A (Nov. 1, 1986).

Patent Abstracts of Japan, vol. 017, No. 430 (M–1460), Aug. 10, 1993, abstract of JP 05 092665A (Apr. 16, 1993) & JP 05 092665A (Apr. 16, 1993).

* cited by examiner

*Primary Examiner*—Bruce H. Hess
(74) *Attorney, Agent, or Firm*—Cooper & Dunham LLP

(57) ABSTRACT

A thermosensitive recording composition includes a leuco dye, a color developer containing 4,4'-bisphenol S, and a sensitizer containing 4-acetylbiphenyl. A thermosensitive recording material has a support and a thermosensitive recording layer which is provided on the support and contains the above-mentioned thermosensitive recording composition.

8 Claims, 1 Drawing Sheet

FIGURE
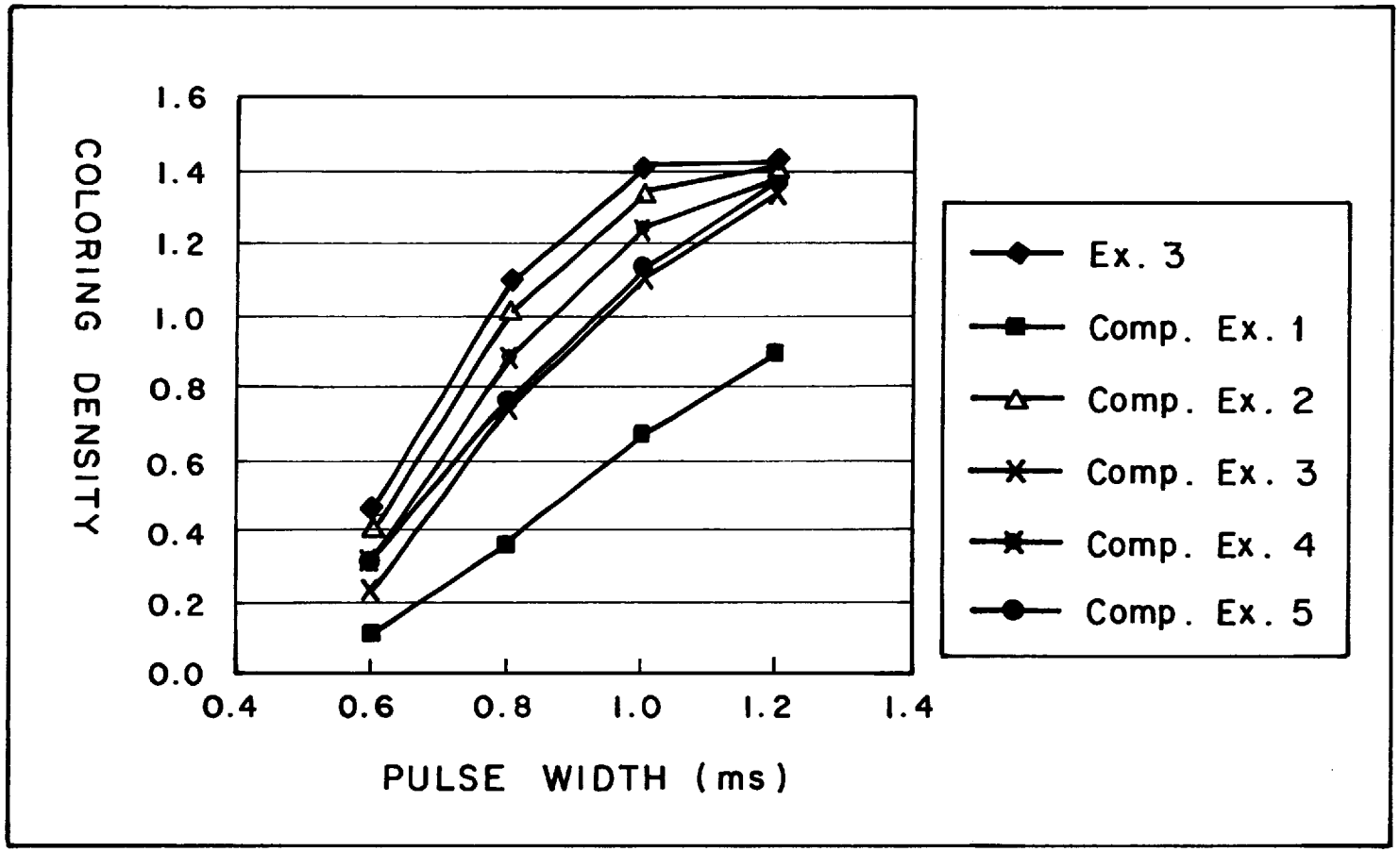

THERMOSENSITIVE RECORDING COMPOSITION AND THERMOSENSITIVE RECORDING MATERIAL USING THE SAME

BACKGROUND OF THE INVENTION

1. Field of the Invention

The present invention relates to a thermosensitive recording composition, and a thermosensitive recording material employing the above-mentioned recording composition.

2. Discussion of Background

The thermosensitive recording material has such a structure that a thermosensitive recording layer capable of inducing color development by the application of heat thereto is provided on a support such as a sheet of paper or synthetic paper, or a resin film. A thermal printer equipped with a built-in thermal head is usually used as heat application means for inducing the color development.

The thermosensitive recording system using the above-mentioned thermosensitive recording material is advantageous over other conventional recording systems because development and image fixing steps are not necessary, recording can be readily achieved using a relatively simple apparatus, and the manufacturing cost can be reduced. The thermosensitive recording system is therefore used in various fields. For example, a thermosensitive recording label sheet is attached to the wrapping material for perishable foods and cooked foods in the field of point-of-sales (POS) system; copies of books and documents are made using the thermosensitive recording material in the copying field; the facsimile machine transmits images using the thermosensitive recording material in the communication field; and data is output on a ticket paper or receipt employing the thermosensitive recording material. In the above-mentioned wide range of applications, the thermosensitive recording material is required to have heat resistance when attached to the wrapping material for cooked food in view of heating treatment before the cooked food is served. On the other hand, it is not necessary to consider the heat resistance and the long-term preservability of the thermosensitive label attached to the wrapping material for perishable foods. Further, when the thermosensitive recording material is used as a receipt paper for money or goods, there is a demand for the preservation stability of the images recorded in the thermosensitive recording material for several years. In other words, the requirements for the thermosensitive recording material, in particular, with respect to the heat resistance and preservation stability, have expanded in line with diversified usage thereof.

The thermosensitive recording composition comprises as the main components a leuco dye that is colorless or light-colored at room temperature and a color developer such as an organic acid material capable of inducing color formation in the leuco dye by the reaction with the leuco dye upon application of heat. The thermosensitive recording layer comprising a composition prepared by adding a sensitizer to the above-mentioned leuco dye and color developer is provided on a support, thereby producing a thermosensitive recording material.

As the color developer for use in the conventional thermosensitive recording material, bisphenol A is widely used. The use of bisphenol A has been controlled in consideration of environmental protection, so that it is inevitable to develop a substitute for bisphenol A as the color developer.

It is 4,4'-bisphenol S that has been regarded as the substitute for bisphenol A because it is non-toxic and easily available in the same manner as in bisphenol A. However, 4,4'-bisphenol S has a melting point of 245° C. or more when measured by DSC, that is relatively higher than those of other color developers, and in addition, shows considerably poor coloring sensitivity. Therefore, the use of 4,4'-bisphenol S as the color developer has not been put to practical use.

Many trials are made to improve the coloring sensitivity of 4,4'-bisphenol S by the addition thereto of a variety of sensitizers, for example, bis(p-methylbenzyl)oxalate, 4-acetotoluidide, 1,2-bis(3-methylphenoxy)ethane, and various thermofusible materials. However, the coloring sensitivity is still insufficient at the present stage.

Furthermore, when 4,4'-bisphenol S is used as the color developer, slight color development is unfavorably induced in the preparation of a coating liquid for thermosensitive recording layer. After the thermosensitive recording layer is provided using the above-mentioned coating liquid, the color development gradually proceeds to lower the degree of whiteness in the background portion of the recording material. Namely, the so-called fogging problem is caused. In light of the above-described disadvantages of 4,4'-bisphenol S, the use of 4,4'-bisphenol S as the color developer in the thermosensitive recording material has been considered to be difficult.

SUMMARY OF THE INVENTION

It is therefore a first object of the present invention to provide a thermosensitive recording composition free of toxicity and the cause of environmental pollution, which shows high coloring sensitivity without causing any color development at the step of preparing a coating liquid or any phenomenon of fogging on the background after the coating liquid is coated.

A second object of the present invention is to provide a remarkably useful thermosensitive recording material.

The first object of the present invention can be achieved by a thermosensitive recording composition comprising a leuco dye, a color developer comprising 4,4'-bisphenol S, and a sensitizer comprising 4-acetylbiphenyl.

The second object of the present invention can be achieved by a thermosensitive recording material comprising a support, and a thermosensitive recording layer which is provided on the support and comprises a thermosensitive recording composition comprising a leuco dye, a color developer comprising 4,4'-bisphenol S, and a sensitizer comprising 4-acetylbiphenyl.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a graph showing the coloring properties of a thermosensitive recording composition comprising 4,4'-bisphenol S and 4-acetylbiphenyl together according to the present invention.

DESCRIPTION OF THE PREFERRED EMBODIMENTS

With special attention being paid to the fact that 4,4'-bisphenol S is not an environmental pollutant, the inventors of the present invention have intensively examined the problems caused by the use of 4,4'-bisphenol S as the color developer in the thermosensitive recording material, that is, insufficient coloring sensitivity and occurrence of fogging. As a result, it was found that excellent coloring sensitivity can be obtained and the fogging can be effectively minimized when 4,4'-bisphenol S is used in combination with 4-acetylbiphenyl serving as a sensitizer.

A single FIGURE is a graph showing excellent coloring properties of a thermosensitive recording composition in which 4,4'-bisphenol S is used in combination with 4-acetylbiphenyl according to the present invention. As is apparent from the figure, high sensitivity and high coloring density can be obtained when a thermosensitive recording composition of the present invention is employed.

Further, there is found the secondary effect of 4-acetylbiphenyl that the color development in the course of preparation of the coating liquid can be controlled although this effect is slight. It is considered that 4-acetylbiphenyl works to prevent the color developer of 4,4'-bisphenol S from causing color development.

In the amid of the industrial demand for the absence of environmental problem, the thermosensitive recording material of the present invention can be substituted for the conventional thermosensitive recording materials.

The use of 4,4'-bisphenol S as the color developer, and the use of 4-acetylbiphenyl as the sensitizer in the thermosensitive recording material are separately known, apart from the respective effects, as disclosed in Japanese Laid-Open Patent Application 61-246088 and the like. However, there is no literature suggesting the combination of 4,4'-bisphenol S and 4-acetylbiphenyl in this kind of thermosensitive recording material. As a matter of course, it is not known that the combination of 4,4'-bisphenol S and 4-acetylbiphenyl exhibits a peculiar sensitizing effect.

Although the reason why 4,4'-bisphenol S can be particularly sensitized only by 4-acetylbiphenyl has not been clarified, such a high sensitizing effect is considered to result from high compatibility of 4,4'-bisphenol S with 4-acetylbiphenyl. The moment 4-acetylbiphenyl is fused upon application of heat thereto, 4,4'-bisphenol S is instantaneously melted together to induce color development.

In addition, when a coating liquid comprising the thermosensitive recording composition of the present invention is prepared, 4-acetylbiphenyl can act on 4,4'-bisphenol S, thereby inhibiting the color development in the coating liquid, as mentioned above. Further, after the thermosensitive recording material is prepared, fogging of the background portion of the recording material can be prevented during the storage thereof when 4,4'-bisphenol S is used in combination with 4-acetylbiphenyl in the thermosensitive recording composition. Such secondary effects brought about by 4-acetylbiphenyl are not described in the above-mentioned Japanese Laid-Open Patent Application 61-246088 and the like.

In the present invention, when the purity of 4,4'-bisphenol S is increased to 99.5% or more, for example, by recrystallization, the color development in the coating liquid and the fogging of the background portion of the obtained recording material can be significantly reduced. The reason for this is considered to be as follows.

The above-mentioned color development in the coating liquid and fogging of the recording material are basically considered to result from a high solubility of 4,4'-bisphenol S in water. The presence of a strong sulfuric acid component remaining as the impurity in 4,4'-bisphenol S is one of the causes to increase the solubility of 4,4'-bisphenol S in water. Therefore, the color development in the coating liquid and the fogging of the recording material can be remarkably reduced by increasing the purity of the employed 4,4'-bisphenol S. However, the solubility of 4,4'-bisphenol S in water is inherently high, so that the above-mentioned problems cannot be sufficiently solved merely by increasing the purity of 4,4'-bisphenol S. In the present invention, therefore, the temperature is severely controlled at the step of dispersing 4,4'-bisphenol S in water. To be more specific, the temperature of the dispersion of 4,4'-bisphenol S is controlled to less than 40° C., thereby effectively reducing the occurrence of the above-mentioned problems. The solubility in water is generally dependent on the temperature. In the case of 4,4'-bisphenol S, the solubility rapidly increases when the temperature of the above-mentioned dispersion is 40° C. or more.

Further, the above-mentioned problems of color development in the coating liquid and fogging of the recording material can be reduced when the leuco dye for use in the thermosensitive recording composition comprises at least one leuco dye component selected from the group consisting of 3-dibutylamino-6-methyl-7-anilinofluoran, 3-di(n-pentyl) amino-6-methyl-7-anilinofluoran, and 3-(N-ethyl-N-p-toluidino)-6-methyl-7-anilinofluoran.

With respect to the prevention of the above-mentioned problems, the kind of leuco dye is not associated with the combination of 4,4'-bisphenol S and 4-acetylbiphenyl. However, the above leuco dye components are preferable because they do not readily cause the color formation when mixed with 4,4'-bisphenol S and 4-acetylbiphenyl to prepare a coating liquid. More specifically, the coating liquid for thermosensitive recording layer comprising 4,4'-bisphenol S becomes slightly acid, with the pH range 7.0–6.5. The above leuco dye components have such properties that color development does not easily take place in the above-mentioned pH range.

In the thermosensitive recording composition of the present invention, it is preferable that 4,4'-bisphenol S be contained in an amount of 100 to 700 parts by weight, more preferably 250 to 550 parts by weight, with respect to 100 parts by weight of the leuco dye. When the amount of 4,4'-bisphenol S is less than 100 parts by weight, the coloring density is insufficient. Even when the amount of 4,4'-bisphenol S exceeds 700 parts by weight, the coloring density becomes saturated.

It is preferable that 4-acetylbiphenyl be contained in an amount of 20 to 300 parts by weight, more preferably 50 to 250 parts by weight, with respect to 100 parts by weight of the leuco dye. When the amount of 4-acetylbiphenyl is less than 20 parts by weight, the sensitizing effect is insufficient. Even when the amount of 4-acetylbiphenyl exceeds 300 parts by weight, the sensitizing effect becomes saturated.

To prepare the thermosensitive recording material of the present invention, a thermosensitive recording layer is provided on a support such as a sheet of plain paper or synthetic paper, or a resin film, the recording layer comprising the above-mentioned thermosensitive recording composition. To improve the sensitivity, the thermosensitive recording material may further comprise an undercoat layer comprising void particles, which undercoat layer is interposed between the support and the thermosensitive recording layer. The thermosensitive recording material thus prepared is remarkably useful in practice. The provision of this kind of undercoat layer, which is disclosed in the literature, is an effective means for enhancing the coloring properties of the recording material. However, the sensitivity of the thermosensitive recording material containing 4,4'-bisphenol S as the color developer, not containing the sensitizer of 4-acetylbiphenyl cannot attain to the practical level even though the undercoat layer is interposed. The provision of the undercoat layer can promote the sensitizing effect in the thermosensitive recording material employing the combination of 4,4'-bisphenol S and 4-acetylbiphenyl.

The thermosensitive recording composition of the present invention comprises at least one leuco dye component. Any leuco dye compounds for use in the conventional thermosensitive recording materials are usable as long as color formation is not induced in the selected leuco dye compound when the leuco dye compound is just mixed with 4,4'-bisphenol S to prepare a coating liquid for thermosensitive recording layer.

For example, triphenylmethane leuco compounds, fluoran leuco compounds, phenothiazine leuco compounds, auramine leuco compounds, spiropyran leuco compounds, and indolinophthalide leuco compounds are preferably used. As previously mentioned, it is preferable that the leuco dye for use in the thermosensitive recording composition comprise at least one selected from the group consisting of 3-dibutylamino-6-methyl-7-anilinofluoran, 3-di(n-pentyl)amino-6-methyl-7-anilinofluoran, and 3-(N-ethyl-N-p-toluidino)-6-methyl-7-anilinofluoran.

In addition to the above-mentioned leuco dye compounds, the following leuco dye compounds are preferably used in the present invention:

3,3-bis(p-dimethylaminophenyl)phthalide,
3,3-bis(p-dimethylaminophenyl)-6-dimethylaminophthalide (crystal violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-N-methyl-N-isobutyl-6-methyl-7-anilinofluoran,
3-N-ethyl-N-isoamyl-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-{N-(3'-trifluoromethylphenyl)amino}-6-diethylaminofluoran,
2-{3,6-bis(diethylamino)-9-(o-chloroanilino)xanthylbenzoic acid lactam},
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran,
Benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morphorino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-methyl-N-isopropylamino)-6-methyl-7-anilinofluoran,
3-diethylamino-6-ethyl-7-(3-methylanilino)fluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-(p-dimethylaminophenyl)-3-{1,1-bis(p-dimethylaminophenyl)ethylen-2-yl}phthalide,
3-(p-dimethylaminophenyl)-3-{1,1-bis(p-dimethylaminophenyl)ethylen-2-yl}-6-dimethylaminophthalide,
3-(p-dimethylaminophenyl)-3-(1-p-dimethylaminophenyl-1-phenylethylen-2-yl)phthalide,
3-(p-dimethylaminophenyl)-3-(1-p-dimethylaminophenyl-1-p-chlorophenylethylen-2-yl)-6-dimethylaminophthalide,
3-(4'-dimethylamino-2'-methoxy)-3-(1"-p-dimethylaminophenyl-1"-p-chlorophenyl-1",3"-butadien-4"-yl)benzophthalide,
3-(4'-dimethylamino-2'-benzyloxy)-3-(1"-p-dimethylaminophenyl-1"-phenyl-1",3"-butadinen-4"-yl)benzophthalide,
3-dimethylamino-6-dimethylamino-fluorene-9-spiro-3'-(6'-dimethylamino)phthalide,
3,3-bis{2-(p-dimethylaminophenyl)-2-(p-methoxyphenyl)ethenyl}-4,5,6,7-tetrachlorophthalide,
3-bis{1,1-bis(4-pyrrolidinophenyl)ethylen-2-yl}-5,6-dichloro-4,7-dibromophthalide,
bis(p-dimethylaminostyryl)-1-naphthalenesulfonylmethane, and
bis(p-dimethylaminostyryl)-1-p-tolylsulfonylmethane.

To improve the properties of the thermosensitive recording material such as preservation stability, an auxiliary additive may be contained in the thermosensitive recording layer. For example, a hindered phenol compound which is an electron acceptor compound similar to the color developer, but has less capability of inducing color formation than the color developer is preferably added as the additive.

Specific examples of the hindered phenol compounds for use in the present invention are as follows:

2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol), tetrabromobisphenol A,
tetrabromobisphenol S,
4,4'-thiobis(2-methylphenol), and
4,4'-thiobis(2-chlorophenol).

In particular, the use of 1,1,3-tris(2-methyl-4-hydroxy-5-cyclohexylphenyl)butane is most effective.

To obtain a thermosensitive recording material of the present invention, the thermosensitive recording layer comprising the above-mentioned leuco dye, color developer, and sensitizer is provided on the support. Any conventional binder agent may be appropriately used to fix the above-mentioned components for use in the recording layer to the support.

Specific examples of the binder agent for use in the thermosensitive recording layer include water soluble polymers such as poly(vinyl alcohol), starch and starch derivatives, cellulose derivatives such as hydroxymethyl cellulose, hydroxyethyl cellulose, carboxymethyl cellulose, methyl cellulose, and ethyl cellulose, sodium polyacrylate, poly(vinyl pyrrolidone), acrylamide—acrylic ester copolymer, acrylamide—acrylic ester—methacrylic acid terpolymer, alkali salts of styrene—maleic anhydride copolymer, alkali salts of isobutylene—maleic anhydride copolymer, polyacrylamide, sodium alginate, gelatin, and casein; emulsions such as poly(vinyl acetate), polyurethane, poly(acrylic acid), poly(acrylic ester), vinyl chloride—vinyl acetate copolymer, poly(butyl methacrylate), and ethylene—vinyl acetate copolymer; and latexes such as styrene—butadiene copolymer and styrene—butadiene—acrylic copolymer.

In addition to 4-acetylbiphenyl, other thermofusible materials may be used together as the sensitizers, with the heat resistance of the employed sensitizers being taken into consideration.

Specific examples of the thermofusible materials for use in the thermosensitive recording layer are fatty acids such as stearic acid and behenic acid; fatty amides such as stearamide and palmitamide; fatty acid metallic salts such as zinc stearate, aluminum stearate, calcium stearate, zinc palmitate, and zinc behenate; and p-benzylbiphenyl, m-terphenyl, triphenylmethane, benzyl p-benzyloxybenzoate, β-benzyloxy naphthalene, phenyl β-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio) ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy) biphenyl, p-aryloxybiphenyl, p-propargyloxybiphenyl, dibenzoyloxymethane, dibenzoyloxypropane, dibenzyl disulfide, 1,1-diphenylethanol, 1,1-diphenylpropanol, p-(benzyloxy)benzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, 1,2-bis(3,4-dimethylphenyl)ethane, dibenzyl oxalate, bis(4-methylbenzyl)oxalate, bis(4-chlorobenzyl) oxalate, and 4-acetotoluidino.

When necessary, the thermosensitive recording layer for use in the present invention may further comprise additive components such as a filler, a surface active agent, a lubricant and an agent for preventing color formation by pressure application, which are used in the conventional thermosensitive recording materials.

Examples of the filler for use in the present invention are finely-divided particles of inorganic fillers such as calcium carbonate, silica, zinc oxide, titanium oxide, aluminum hydroxide, zinc hydroxide, barium sulfate, clay, kaolin, talc, surface-treated calcium, and surface-treated silica; and finely-divided particles of organic fillers such as urea—formalin resin, styrene—methacrylic acid copolymer, polystyrene resin, and vinylidene chloride resin.

Examples of the lubricant for use in the present invention include higher fatty acids and amides, esters and metallic salts thereof; and a variety of waxes such as an animal wax, a vegetable wax, a mineral wax, and a petroleum wax.

As previously mentioned, the undercoat layer mainly comprising void particles may be interposed between the support and the thermosensitive recording layer in order to improve the sensitivity of the recording layer. In this case, it is preferable that the void particles comprise a thermoplastic resin for forming shell of the particles. The void particles may have a voidage of 30% or more, more preferably in the range of 33 to 99%. The term of "voidage" herein used represents the ratio of the inner diameters to the outer diameters of the void particles, expressed by the formula of (inner diameters of void particles/outer diameters of void particles)×100(%). Further, it is preferable that the void particles have a weight average particle diameter of 0.4 to 10 μm. The undercoat layer may be provided on the support in a deposition amount of 2 to 10 g/m$^2$, more preferably 2.5 to 7 g/m$^2$ on a dry basis.

The thermosensitive recording material of the present invention may further comprise a protective layer which is provided on the thermosensitive recording layer. The protective layer may comprise a water-soluble resin, aqueous emulsion, or hydrophobic resin in consideration of the transparency, chemical resistance, water resistance, wear resistance, and light resistance of the thermosensitive recording material, and the head-matching properties with respect to the employed thermal head. Alternatively, the protective layer may be prepared using an ultraviolet curing resin or electron radiation curing resin.

Using the above-mentioned components, the thermosensitive recording material of the present invention can be produced by the following method. Namely, a leuco dye and 4,4'-bisphenol S serving as the color developer are separately dispersed and pulverized with a binder agent and other additives when necessary using a dispersion mill such as a ball mill, attritor, or sand mill by the conventional method. For the pulverizing and dispersing operation of a wet type, water is commonly used as a dispersion medium. A sensitizer comprising 4-acetylbiphenyl and other additives are also separately mixed together with a binder agent. The dispersions of the leuco dye and the color developer, and the liquid of sensitizer are thereafter mixed to prepare a coating liquid for thermosensitive recording layer. Furthermore, the coating liquid for undercoat layer and/or the coating liquid for protective layer may be prepared using the above-mentioned components together with an appropriate binder agent or other additives when necessary. When the undercoat layer is provided, the coating liquid for undercoat layer may be coated on a support such as a sheet of paper or synthetic paper or a plastic film. Then, the coating liquid for thermosensitive recording layer and the coating liquid for protective layer may be successively coated and dried, thereby producing a thermosensitive recording material of the present invention.

Other features of this invention will become apparent in the course of the following description of exemplary embodiments, which are given for illustration of the invention and are not intended to be limiting thereof.

EXAMPLE 1

<Formation of Thermosensitive Recording Layer>

A mixture of the following components was separately dispersed and pulverized in a sand grinder to have a weight average particle diameter of about 1.0 μm, so that a Liquid A and a Liquid B were prepared:

| | Parts by Weight |
|---|---|
| [Liquid A] | |
| 3-dibutylamino-6-methyl-7-anilinofluoran | 20 |
| 10% aqueous solution of poly(vinyl alcohol) | 20 |
| Water | 60 |
| [Liquid B] | |
| 4,4'-bisphenol S (Trademark: "BS-3", made by Konishi Chemical Ind. Co., Ltd.) purity: 98.2% | 20 |
| 10% aqueous solution of poly(vinyl alcohol) | 30 |
| Amorphous silica (Trademark: "P-603", made by Mizusawa Industrial Chemicals, Ltd.) | 10 |
| Water | 40 |

Furthermore, the following components were separately mixed, so that a Liquid C and a Liquid D were prepared:

| | Parts by Weight |
|---|---|
| [Liquid C] | |
| Montanic acid ester (lubricant for improving the head-matching properties) (Trademark: "WAX-E", made by Hoechst Gosei K.K.) | 20 |
| 10% aqueous solution of poly(vinyl alcohol) | 20 |
| Water | 60 |
| [Liquid D] | |
| 4-acetylbiphenyl | 20 |
| 10% aqueous solution of poly(vinyl alcohol) | 20 |
| Water | 60 |

The Liquid A, the liquid B, the liquid C, and the Liquid D were mixed at a ratio by weight of 10:40:5:10, so that a coating liquid for thermosensitive recording layer was prepared. The thus prepared thermosensitive recording layer coating liquid was coated on a sheet of commercially available high quality paper with a basis weight of 45 g/m$^2$, serving as a support, and then dried so as to have a leuco dye deposition amount of 0.5 g/m$^2$ on a dry basis. The surface of the recording layer was subjected to calendering to have a surface smoothness of about 1000 seconds in terms of Bekk's smoothness. Thus, a thermosensitive recording material No. 1 according to the present invention was prepared.

EXAMPLE 2

The procedure for preparation of the thermosensitive recording material No. 1 in Example 1 was repeated except that the 4,4'-bisphenol S with a purity of 98.2% for use in the Liquid B in Example 1 was replaced by a commercially available product of 4,4'-bisphenol S (Trademark: "BPS-P", made by NICCA CHEMICAL CO., LTD.) with a purity of 99.8%.

Thus, a thermosensitive recording material No. 2 according to the present invention was prepared.

EXAMPLE 3

<Formation of Undercoat Layer>

The following components were mixed to prepare a coating liquid for undercoat layer.

| | Parts by Weight |
|---|---|
| Void particles comprising styrene - acrylic resin (27.5% emulsion) (Trademark: "OP-91", made by Rohm and Haas Company) | 40 |
| Styrene - butadiene latex (50% emulsion) | 10 |
| Water | 50 |

The thus prepared undercoat layer coating liquid was coated on a sheet of commercially available high quality paper with a basis weight of 45 g/m$^2$, serving as a support, and then dried so as to have a deposition amount of 4.0 g/m$^2$ on a dry basis. Thus, an undercoat layer was provided on the support.

<Formation of Thermosensitive Recording Layer>

The same thermosensitive recording layer coating liquid as employed in Example 1 was coated on the above prepared undercoat layer, and then dried so as to have a leuco dye deposition amount of 0.5 g/m$^2$ on a dry basis. The surface of the recording layer was subjected to calendering to have a surface smoothness of about 1000 seconds in terms of Bekk's smoothness. Thus, a thermosensitive recording material No. 3 according to the present invention was prepared.

EXAMPLE 4

The procedure for preparation of the thermosensitive recording material No. 3 in Example 3 was repeated except that 3-dibutylamino-6-methyl-7-anilinofluoran for use in the Liquid A for preparation of the thermosensitive recording layer coating liquid in Example 3 was replaced by 3-(N-ethyl-N-p-toluidino)-6-methyl-7-anilinofluoran.

Thus, a thermosensitive recording material No. 4 according to the present invention was prepared.

EXAMPLE 5

The procedure for preparation of the thermosensitive recording material No. 3 in Example 3 was repeated except that 3-dibutylamino-6-methyl-7-anilinofluoran for use in the Liquid A for preparation of the thermosensitive recording layer coating liquid in Example 3 was replaced by 3-(N-ethyl-N-isoamyl)-6-methyl-7-anilinofluoran.

Thus, a thermosensitive recording material No. 5 according to the present invention was prepared.

Comparative Example 1

The procedure for preparation of the thermosensitive recording material No. 3 in Example 3 was repeated except that 4,4'-bisphenol S for use in the Liquid B for preparation of the thermosensitive recording layer coating liquid in Example 3 was replaced by bisphenol A, and that 4-acetylbiphenyl for use in the Liquid D for preparation of the thermosensitive recording layer coating liquid in Example 3 was replaced by bis(p-methylbenzyl)oxalate.

Thus, a comparative thermosensitive recording material No. 1 was prepared.

Comparative Example 2

The procedure for preparation of the thermosensitive recording material No. 3 in Example 3 was repeated except that the Liquid D containing 4-acetylbiphenyl was not used to prepare the thermosensitive recording layer coating liquid.

Thus, a comparative thermosensitive recording material No. 2 was prepared.

Comparative Example 3

The procedure for preparation of the thermosensitive recording material No. 3 in Example 3 was repeated except that 4-acetylbiphenyl for use in the Liquid D for preparation of the thermosensitive recording layer coating liquid in Example 3 was replaced by bis(p-methylbenzyl)oxalate.

Thus, a comparative thermosensitive recording material No. 3 was prepared.

Comparative Example 4

The procedure for preparation of the thermosensitive recording material No. 3 in Example 3 was repeated except that 4-acetylbiphenyl for use in the Liquid D for preparation of the thermosensitive recording layer coating liquid in Example 3 was replaced by 4-acetotoluidide.

Thus, a comparative thermosensitive recording material No. 4 was prepared.

Comparative Example 5

The procedure for preparation of the thermosensitive recording material No. 3 in Example 3 was repeated except that 4-acetylbiphenyl for use in the Liquid D for preparation of the thermosensitive recording layer coating liquid in Example 3 was replaced by 1,2-bis(3-methylphenoxy) ethane.

Thus, a comparative thermosensitive recording material No. 5 was prepared.

Each of the thermosensitive recording materials No. 1 to No. 5 according to the present invention and the comparative thermosensitive recording materials No. 1 to No. 5 was subjected to the evaluation tests in the following manner.

<Coloring Properties>

Using a printing simulator for thermosensitive recording material, made by Okura Electric Company, thermal printing was carried out at the applied energy of 27.7 W/mm$^2$, with the pulse width being changed to 0.60, 0.80, 1.00, and 1.20 ms. Under each condition, the coloring density of a printed portion was measured by use of a Macbeth densitometer RD-914. In this case, the density of a non-printed portion, that is, the background portion of the recording material was also measured to evaluate the fogging. In other words, it was confirmed whether color development had occurred in the thermosensitive recording layer coating liquid. The results are shown in the following TABLE.

<Fogging of Background>

Using the same printing simulator as mentioned above, thermal printing was carried out at the applied energy of 27.7 W/mm$^2$, with the pulse width being set at 1.20 ms.

The thus obtained thermosensitive recording materials were allowed to stand at 80° C. for 24 hours. Then, the density of the background portion was measured. By comparing the density of the background portion obtained immediately after thermal printing with the density obtained after storage under the same conditions in terms of the pulse width, the fogging of the background was evaluated. The density of the image portion after storage was also measured for reference. The results are shown in the following TABLE 1.

TABLE 1

| | Coloring Properties | | | | | Fogging | |
|---|---|---|---|---|---|---|---|
| | 0.60 (ms) | 0.80 (ms) | 1.00 (ms) | 1.20 (ms) | Density of back-ground | Density of back-ground | Image Density |
| Ex. 1 | 0.20 | 0.69 | 1.06 | 1.33 | 0.07 | 0.20 | 1.31 |
| Ex. 2 | 0.18 | 0.68 | 1.07 | 1.38 | 0.06 | 0.16 | 1.30 |
| Ex. 3 | 0.46 | 1.09 | 1.41 | 1.42 | 0.06 | 0.16 | 1.31 |
| Ex. 4 | 0.35 | 0.86 | 1.29 | 1.31 | 0.05 | 0.11 | 1.19 |
| Ex. 5 | 0.52 | 1.18 | 1.40 | 1.42 | 0.09 | 0.25 | 1.33 |
| Comp. Ex. 1 | 0.41 | 1.01 | 0.34 | 1.41 | 0.08 | 0.81 | 1.37 |
| Comp. EX. 2 | 0.11 | 0.36 | 0.66 | 0.89 | 0.09 | 0.20 | 0.71 |
| Comp. Ex. 3 | 0.24 | 0.74 | 1.11 | 1.34 | 0.07 | 0.16 | 1.16 |
| Comp. Ex. 4 | 0.32 | 0.88 | 1.24 | 1.37 | 0.07 | 0.19 | 1.25 |
| Comp. Ex. 5 | 0.31 | 0.76 | 1.13 | 1.36 | 0.07 | 0.16 | 1.22 |

The results of the evaluation tests are shown in TABLE 1 and the single figure. As can be seen from the figure, the coloring sensitivity of the recording material (of Example 3) is excellent when compared with those of the comparative recording materials (of Comparative Examples 1 to 5). The sensitivity of the thermosensitive recording material No. 3 is superior to that of the comparative recording material No. 1 employing bisphenol A.

As is apparent from TABLE 1, the density of the background portion is within the range from 0.11 to 0.25 in the thermosensitive recording materials of the present invention after the storage. In contrast to this, the density of the background is as high as 0.81 after the comparative thermosensitive recording material employing bisphenol A is stored.

In the comparative thermosensitive recording material No. 2, the occurrence of fogging was prevented to the same extent as in the thermosensitive recording materials of the present invention. However, the density of the background portion after storage, that is, 0.20, is considered to be low correspondingly to the low coloring density of the image portion, that is, 0.71.

In the comparative thermosensitive recording materials No. 3, No. 4, and No. 5, the coloring sensitivity is poor although the fogging of the background is prevented.

The thermosensitive recording materials of the present invention can meet both the requirements, that is, high sensitivity, and the prevention of fogging.

Japanese Patent Application No. 11-350774 filed Dec. 9, 1999 is hereby incorporated by reference.

What is claimed is:

1. A thermosensitive recording composition comprising:

a leuco dye, a color developer comprising 4,4'-bisphenol S, and a sensitizer comprising 4-acetylbiphenyl.

2. The thermosensitive recording composition as claimed in claim 1, wherein said 4,4'-bisphenol S is purified to 99.5% or more.

3. The thermosensitive recording composition as claimed in claim 1, wherein said leuco dye comprises at least one leuco dye component selected from the group consisting of 3-dibutylamino-6-methyl-7-anilinofluoran, 3-di(n-pentyl) amino-6-methyl-7-anilinofluoran, and 3-(N-ethyl-N-p-toluidino)-6-methyl-7-anilinofluoran.

4. A thermosensitive recording material comprising:

a support, and a thermosensitive recording layer provided on said support, comprising a thermosensitive recording composition comprising a leuco dye, a color developer comprising 4,4'-bisphenol S, and a sensitizer comprising 4-acetylbiphenyl.

5. The thermosensitive recording material as claimed in claim 4, wherein said 4,4'-bisphenol S is purified to 99.5% or more.

6. The thermosensitive recording material as claimed in claim 4, wherein said leuco dye comprises at least one leuco dye component selected from the group consisting of 3-dibutylamino-6-methyl-7-anilinofluoran, 3-di(n-pentyl) amino-6-methyl-7-anilinofluoran, and 3-(N-ethyl-N-p-toluidino)-6-methyl-7-anilinofluoran.

7. The thermosensitive recording material as claimed in claim 4, further comprising an undercoat layer comprising void particles, which undercoat layer is interposed between said support and said thermosensitive recording layer.

8. The thermosensitive recording material as claimed in claim 7, wherein said void particles comprise a thermoplastic resin for forming shell of said void particles, and said void particles have a voidage of 30% or more and a weight average particle diameter of 0.4 to 10 $\mu$m.

* * * * *